United States Patent [19]

Rottmann

[11] 4,057,197

[45] Nov. 8, 1977

[54] APPARATUS FOR FEEDING STRIP MATERIAL TO GLUEING DEVICE

[75] Inventor: Manfred Rottmann, Hiddenhausen, Germany

[73] Assignee: F. Meyer & Schwabedissen GmbH & Co. KG., Herford, Germany

[21] Appl. No.: 691,554

[22] Filed: May 25, 1976

[30] Foreign Application Priority Data

June 12, 1975 Germany ..... 2526158

[51] Int. Cl.[2] ..... B65H 19/04

[52] U.S. Cl. ..... 242/58; 226/110; 242/55.3

[58] Field of Search ..... 242/58, 78.6, 78.7, 242/58.1, 58.2, 58.3, 58.4, 55.3; 226/108, 109, 110, 111

[56] References Cited

U.S. PATENT DOCUMENTS

| | | | |
|---|---|---|---|
| 3,472,463 | 10/1969 | Fedor et al. | 242/78.7 |
| 3,685,760 | 8/1972 | Fedor | 242/78.7 |
| 3,850,356 | 11/1974 | Abe et al. | 242/58 |

*Primary Examiner*—George F. Mautz
*Attorney, Agent, or Firm*—Michael J. Striker

[57] ABSTRACT

Two horizontally spaced adjacent stacks of vertically spaced support plates are vertically displaceable for aligning any of the plates with a fixed take-off station. A supply of strip material is provided on each plate and may be gripped between a fixed continuously driven roller and a displaceable roller. A controller may move any of the displaceable rollers toward or away from the respective fixed roller in order to pinch the strip material from the respective supply and feed it into the take-off guide aligned therewith.

11 Claims, 2 Drawing Figures

12
10
11
16
9
6
16
8
17
V
7

CONTROLLER
D
II
24
5
4
1
17
14
13
19
23
27
26
18
15
8
2
3
9
6
10
16
25
11
21
12
22

APPARATUS FOR FEEDING STRIP MATERIAL TO GLUEING DEVICE

BACKGROUND OF THE INVENTION

The present invention relates to a feed apparatus for strip material. More particularly this invention concerns such a device for feeding strip material to an apparatus which glues this material to the edge of a flat workpiece, as in a plant where decorative wooden panels are manufactured.

In the manufacture of decorative lumber and the like the workpieces are first provided in their flat faces with decorative foils carrying a wood grain or similar decoration. Thereafter these workpieces in certain installations are passed through devices which glue to their narrow edges strip material of the same grain or decorative type. Normally in such operations the workpiece is displaced horizontally with the edge to which the strip is to be applied standing vertically.

In a well known feed apparatus for supplying the strip material to the glueing device a pair of rolls of the strip material are held horizontally next to each other. The strip from each of the rolls passes through a respective pair of rollers at least one of which is driven and then through a take-off guide constituted by a pair of spaced-apart channel-defining metal guides to a respective glueing device. When the one supply is exhausted the device switches over to the other supply for continuous operation. During use of the second supply it is possible for an operator to load a new supply of strip material into the first holder and thereby allow the assembly procedure to operate continuously.

A considerable disadvantage of this arrangement is that it is necessary for an operator to keep continuous watch over the device in order to replenish the rolls as they are used up, as in a fast operation a single roll of such a strip material can be used up in just a few minutes. Another disadvantage is that the feed apparatus must be completely reloaded each time the workpiece thickness or type changes. Thus if a run of different workpiece types is being manufactured it is necessary completely to reload the device. Such reloading entails the removal and unthreading of each of the rolls of strip material and placement of new rolls in their place, along with subsequent reinsertion of the free ends of these rolls into the respective take-off guides for the glueing devices.

SUMMARY OF THE INVENTION

It is therefore an object of the present invention to provide an improved feed apparatus.

Another object of this invention is the provision of such an apparatus usable with a device for glueing such strip material to the edge of a workpiece passing horizontally past the glueing device.

Yet another object is to provide such an apparatus wherein an operator need not continuously watch the device in order to keep it filled and wherein different types of strip stock can be continuously held for use with different types of thicknesses of workpiece.

These objects are attained according to the present invention in a feed apparatus for strip material wherein a stack of support plates spaced apart in a direction each have means for holding a supply of strip material so that several different types of strip material may be stocked in the device or a very large supply of one type. Means is provided for displacing this stack in the spacing direction of the plates through a plurality of positions each corresponding to alignment of a respective one of the plates with a fixed take-off guide. A fixed roller is provided on each of the plates and next to this roller a displaceable roller which is coupled to means for displacing it toward and away from the respective fixed roller for pinching strip material and pulling it from the respective supply. Means is provided in the apparatus for rotating one of the rollers on each plate continuously and thereby pulling the material off the respective supply when the respective rollers pinch the material.

According to another feature of this invention the plates are stacked one above the other so that the above-mentioned direction is upright. In addition the apparatus is provided with means for displacing the plates out of the stack in a transverse direction transverse to the upright direction. Thus each of the plates may be swung or slid horizontally out of the stack in order to provide it with a new supply of strip material. Thus when the apparatus is using up its last supply of strip material an operator need merely swing or slide out the plates and put on each plate a new roll of strip material, positioning the free end of such strip material between the spaced-apart rollers thereon.

Two such stacks of plates are provided in accordance with this invention with each plate in the first stack aligned horizontally with another plate in the second stack. Thus it is possible in a relatively limited floor space to hold a great many rolls of different types of strip material or of the same type of strip material in order to maximize production speed and insure continuous production at all times.

The plates according to this invention are horizontally pivotal on an upright shaft which is driven whenever any of the driven rollers in that stack is to be driven. A toothed belt connects this upright shaft with each of the driven rollers so that even if the respective plate is swung out of the device a complicated decoupling of the drive arrangement for the roller thereon need not be provided. In the case of a pair of horizontally spaced stacks a single roller may be alternately couplable by means of an electromagnetic clutch or the like to either of the upright shafts, but never to both shafts at the same time.

The means for vertically displacing the stack includes a motor and coupled thereto a spindle extending vertically and engaging all of the plates. This spindle is threaded and fits into nuts on each of the plates or on an element secured to each of the plates so that when it is rotated all of the plates move vertically in the same sense.

Each of the plates in accordance with this invention is provided with a sensor which generates an output when the respective supply is exhausted, by which is meant an insufficient quantity of the supply is left for continued operation. A control means is provided which is connected to all of the sensors, to the means for displacing the stack vertically and to all of the means for rotating in order to reverse rotate one of the rollers when the respective sensor means generates its output and for thereafter displacing another plate into alignment with the take-off guide. Thus when the sensor of the supply being used at a given time detects that this supply is exhausted, it generates an output and the control means reverse rotates the rollers associated with that supply so as to withdraw the tail end of the strip being used from the take-off guide. Then a plate carrying a full supply is aligned with the take-off guide and its displaceable roller is brought to bear against the strip thereon, pinching it against the fixed roller and causing the strip to be pulled out of the supply and fed into the take-off guide. In this manner automatic replenishment of the supply is assured with relatively simple means. It is noted, of course, that such reloading is carried out in intervals between glueing operations so that the device insures that a continuous strip is applied to each workpiece.

In accordance with yet another feature of this invention the control means is connected to all of the means for moving the displaceable rollers and to the means for displacing the stack for operating same in such manner that only the strip material of the supply on the plate aligned with the take-off guide is pinched between the respective rollers and all of the other displaceable rollers are out of engagement with the respective strip material. Thus, even though one of the rollers of each pair of rollers is rotating at all times, only the strip on the plate aligned with the take-off guide will be displaced by this rotating roller since only this strip will be pinched between the rollers, the other strips all lying loosely between the rollers so that no driving action is achieved.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF THE PREFERRED EMBODIMENT

Figure 2:
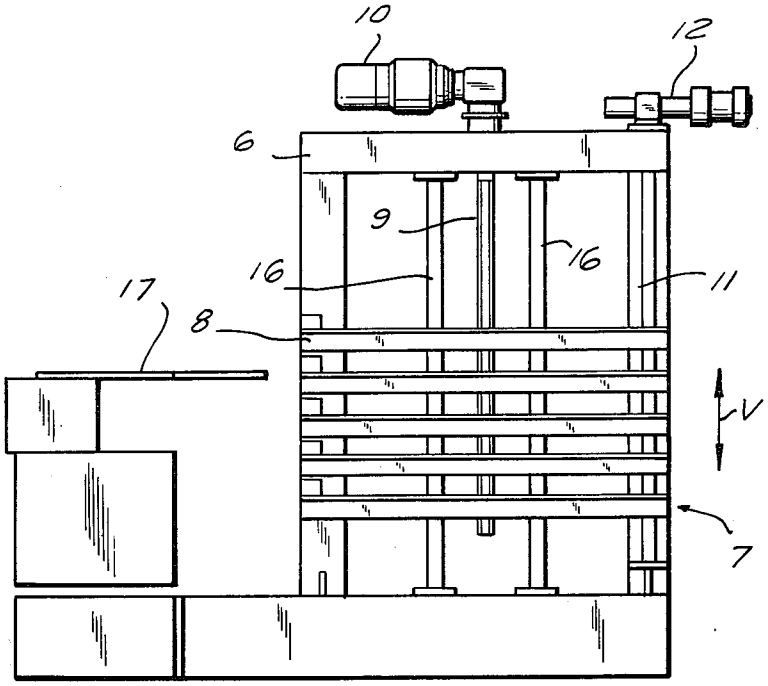
FIG. 2 is a side view taken in the direction of arrow II of FIG. 1.
Figure 1:
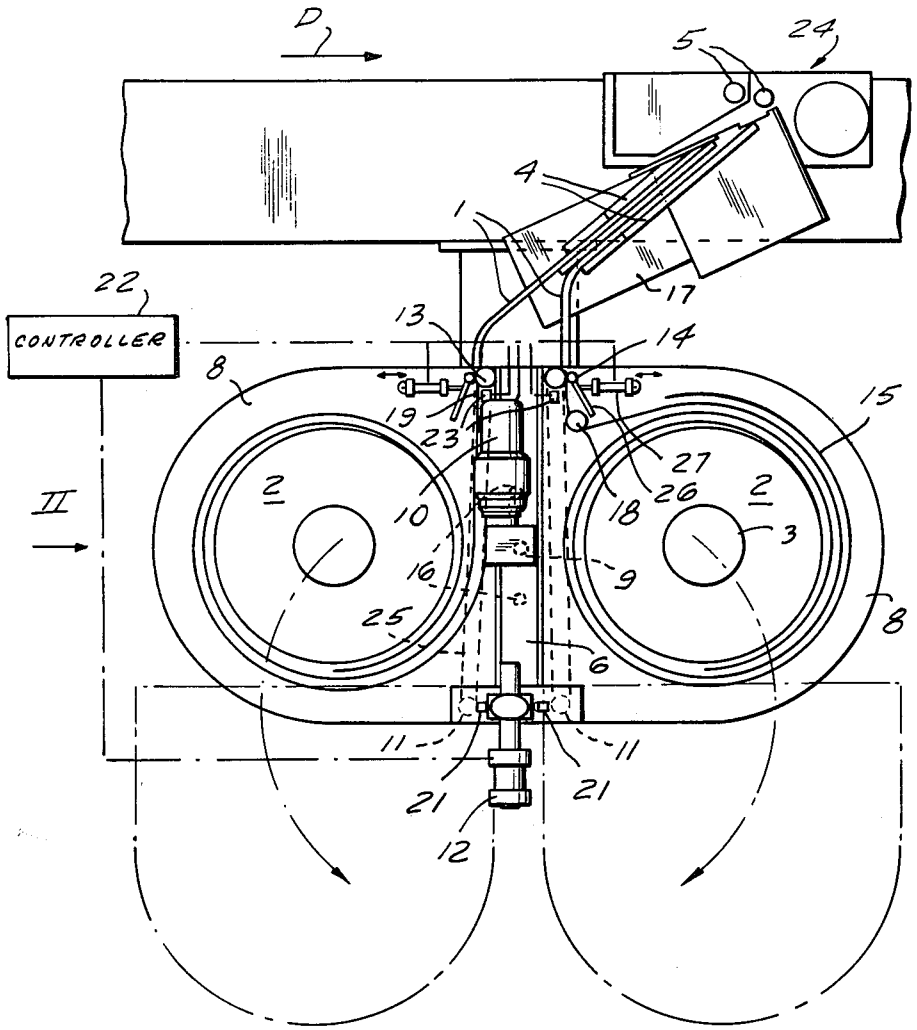
FIG. 1 is a top partly schematic view of the apparatus according to this invention.

As shown in FIGS. 1 and 2 a pair of like strip guides 1 are arranged to feed strip material from a pair of roll supplies 2 each sitting on a respective centering roller 3 to a pressure slide 4. A pair of advancing rollers 5 then apply the strip material to the edge of a workpiece passing in a displacement direction D past the glueing device 24 constituted by the applier 4 and rollers 5.

A frame 6 supports a pair of stacks 7 of vertically spaced and horizontal plates 8, here five plates in each stack although it is equally possible to provide fewer or more plates in each stack 7. Both stacks are vertically displaceable by means of a motor 10 carried on the frame 6 and having a vertical threaded spindle 9 engaging down through a stack of five T-shaped bars vertically guided on vertical rods 16 flanking the spindle 9 and each located between a pair of plates 8. A pair of vertical shafts 11 extend down through the arms of the T-shaped bars between the plates 8 and are both connectable via alternately operable clutches 21 to a drive motor 12 carried on the frame 6.

In addition each of the plates 8 carries a fixed roller 13 connected via a toothed belt 25 to the shaft 11 of the respective stack 7. Thus, since the clutches 21 are alternately actuatable and the motor 12 operates almost continuously all of the rollers 13 of at least one of the stacks will be rotating at all times. In addition each of the plates 8 has a further roller 14 carried on an arm 26 pivoted on the respective plate 8 and operated by a respective pneumatic cylinder 27 so that each roller 14 can be pressed against the corresponding driven roller 13 to pinch the free end 19 of the respective supply 2. In addition each of the plates 8 has a shield 15 that stands up on the plate and is of generally semi-cylindrical shape in order partially to surround the respective supply. The plates 8 of one stack are also provided with a deflecting roller 18 which serves merely to allow the supplies 2 in both stacks 7 to be laid in place in the same orientation.

A control system 22 is connected to the cylinders 27, to the clutches 21, to the motors 10 and 12, and to sensors 23 on each plate 8 that generate an output that is fed to this controller 22 when the respective supply is exhausted.

The device operates as follows:

To start with two of the plates 8 are aligned with the plates 17 supporting the two take-off guides 1. Then one of the cylinders 27 for one of these two plates 8 is actuated in order to pinch the respective strip between the rollers 13 and 14. At the same time the respective shaft 11 is coupled to the motor 12 for forward rotation of the roller 13 so that the strip is pulled off of the respective supply and fed into the end of the respective guide 1. Such feeding is continuous with the displacement of workpieces in direction D past the glueing station 24. The controller only serves to advance the strip material out of the supply 2 when workpieces are passing by.

When the sensor 23 detects that the respective supply is exhausted it generates an output which is fed to the controller that then temporarily reverses operation of the motor 12 to withdraw the free end 19 from the guide 1. Then either the other cylinder 27 of the other plate 8 is operated and the other clutch 21 is closed in order to drive the other supply at the same level of the arrangement off into the other guide 1, or the motor 10 is actuated to bring another level up in the direction V to a position aligned with the plate 17 so that material can be fed from either of the two supplies 2 at this level into the guides 1. The controller may also be interconnected with the entire plant operation so that various different types of strip material can be kept on the stacks 7. Thus even though a supply is not exhausted the controller may reverse-rotate the roller 13 in use in order to pull out the strip being used and allow the device to be set up so that another type of strip material is fed into one of the guides 1.

When any or all of the plates 8 are empty an operator need merely swing out the empty plates 8 and place on each of them a new supply of the correct type of strip material. After placement of the supply between the holding means constituted by the upstanding guide 15 and the central roller 3 the free end 19 is placed between the respective pair of rollers 13 and 14 and the plate is swung back in place. Such a reloading can be carried out while the machine is running.

It will be understood that each of the elements described above, or two or more together, may also find a useful application in other types of apparatus differing from the types described above.

While the invention has been illustrated and described as embodied in a feeding apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A feed apparatus for strip material, said apparatus comprising:

a stack of support plates spaced apart one above another in an upright direction;

means on each of said plates for holding a supply of strip material therein;

means for displacing said stack in said upright direction through a plurality of positions each corresponding to alignment of a respective one of said plates with a fixed take-off guide;

a fixed roller on each of said plates;

a displaceable roller on each of said plates movable toward and away from the respective fixed roller;

means on each of said plates for moving the respective displaceble roller toward the respective fixed roller for pinching the strip material from the respective supply;

means for rotating one of said rollers on each plate and thereby pulling the material off the respective supply when same is pinched between the respective rollers; and means for displacing each of said plates out of said stack in a transverse direction transverse to the upright direction.

2. The apparatus defined in claim 1, further comprising a second stack of second plates each having a respective second means for holding, a second fixed roller, a second displaceable roller, and a second means for rotating, said second stack being horizontally next to the first-mentioned stack with each of said second plates in line with a respective one of the first-mentioned plates.

3. The apparatus defined in claim 2, further comprising means for displacing each of said second plates out of said second stack in a transverse direction transverse to said upright direction, said means for displacing said plates including respective first and second upright shafts pivotally carrying said first and second plates.

4. The apparatus defined in claim 3, wherein said means for rotating includes a single drive motor, means for connecting same alternately to said shafts, and means for connecting said first and second shafts to said one rollers of said first and second plates, respectively.

5. The apparatus defined in claim 1, wherein said means for displacing said plates includes an upright shaft pivotally carrying said plates.

6. The apparatus defined in claim 5, wherein said means for rotating includes a drive motor connected to said upright shaft and means connecting each of said one rollers to said upright shaft.

7. The apparatus defined in claim 6, wherein said means for connecting includes a belt operatively connected between each of said one rollers and said shaft.

8. The apparatus defined in claim 1, wherein said means for displacing said stack includes a motor and coupled thereto a spindle extending in said direction and engaging all of said plates.

9. The apparatus defined in claim 1, wherein said means for holding includes an upstanding guide on each of said plates shaped to at least partially surround the respective supply.

10. A feed apparatus for strip material, said apparatus comprising:

a stack of support plates spaced apart in a direction;

means on each of said plates for holding a supply of strip material thereon;

means for displacing said stack in said direction through a plurality of positions each corresponding to alignment of a respective one of said plates with a fixed take-off guide;

a fixed roller on each of said plates;

a displaceable roller on each of said plates movable toward and away from the respective fixed roller;

means on each of said plates for moving the respective displaceable roller toward the respective fixed roller for pinching the strip material from the respective supply;

means for rotating one of said rollers on each plate and thereby pulling the material off the respective supply when same is pinched between the respective rollers;

sensor means adjacent each supply for generating an output when the respective supply is exhausted; and control means connected to all of said sensor means, to said means for displacing said stack, and to all of said means for rotating for reverse-rotating a one of said rollers when the respective sensor means generates its output and for thereafter displacing another plate into alignment with said take-off guide.

11. A feed apparatus for strip material, said apparatus comprising:

a stack of support plates spaced apart in a direction;

means on each of said plates for holding a supply of strip material thereon;

means for displacing said stack in said direction through a plurality of positions each corresponding to alignment of a respective one of said plates with a fixed take-off guide;

a fixed roller on each of said plates;

a displaceable roller on each of said plates movable toward and away from the respective fixed roller;

means on each of said plates for moving the respective displaceable roller toward the respective fixed roller for pinching the strip material from the respective supply;

means for rotating one of said rollers on each plate and thereby pulling the material off the respective supply when same is pinched between the respective rollers; and control means connected to all of said means for moving said displaceable rollers and to said means for displacing said stacks for operating same in such manner that only the strip material of the supply on the plate aligned with said take-off guide is pinched between the respective rollers and all of the other displaceable rollers are out of engagement with the respective strip material.

* * * * *